US010415907B1

(12) United States Patent
Kincel et al.

(10) Patent No.: US 10,415,907 B1
(45) Date of Patent: Sep. 17, 2019

(54) FIREARM BUFFER WITH BIASING MEMBER

(71) Applicant: BRAVO COMPANY MFG, INC., Hartland, WI (US)

(72) Inventors: Eric Stephen Kincel, Coeur d'Alene, ID (US); Jeffrey James O'Brien, Coeur d'Alene, ID (US)

(73) Assignee: Bravo Company MFG, Inc., Hartland, WI (US)

( * ) Notice: Subject to any disclaimer, the term of this patent is extended or adjusted under 35 U.S.C. 154(b) by 0 days.

(21) Appl. No.: 16/238,813

(22) Filed: Jan. 3, 2019

(51) Int. Cl.
*F41A 3/84* (2006.01)

(52) U.S. Cl.
CPC ..... *F41A 3/84* (2013.01)

(58) Field of Classification Search
CPC ..... F41A 3/84; F41A 3/82; F41A 3/78; F41C 23/06
See application file for complete search history.

(56) References Cited

U.S. PATENT DOCUMENTS

| | | | | |
|---|---|---|---|---|
| 8,296,984 | B2 | 10/2012 | Kincel | |
| 8,943,726 | B2 | 2/2015 | Kincel | |
| 9,341,437 | B1 | 5/2016 | Huang | |
| 9,915,492 | B2 | 3/2018 | Huang | |
| 2014/0075798 | A1* | 3/2014 | Kincel | F41A 3/84 42/1.06 |

* cited by examiner

*Primary Examiner* — J. Woodrow Eldred
(74) *Attorney, Agent, or Firm* — Michael Best & Friedrich LLP

(57) ABSTRACT

A buffer assembly for a firearm includes an internal assembly comprising a plurality of weights and a dead-blow biasing member in the form of a coil compression spring, stack of wave washers, a compression washers, or a compliant portion integrally formed in a rear end cap of the buffer assembly. The dead-blow biasing member is positioned between a flat end of one of the weights and a rear end cap of a buffer body or between flat ends of adjacent weights.

5 Claims, 9 Drawing Sheets

FIREARM BUFFER WITH BIASING MEMBER

BACKGROUND

The present invention relates to a buffer assembly for a firearm. The buffer assembly includes an internal dead-blow biasing member abutting a flat end of a buffer weight to reduce, minimize, or eliminate buffer bounce.

SUMMARY

The present invention provides a buffer assembly for a firearm, the buffer assembly comprising: a buffer tube including a closed rear end; a buffer spring in the tube; and a buffer in the tube and engaging the buffer spring, the buffer including a buffer body defining an internal buffer cavity, a rear end cap covering a rear end of the buffer body, and an internal assembly within the buffer cavity, the internal assembly comprising at least one weight having a flat end and a dead-blow biasing member abutting the flat end of the weight; wherein the buffer is driven rearwardly in the buffer tube in response to operation of the firearm, to compress the buffer spring; wherein upon the rear end cap of the buffer contacting the closed rear end of the buffer tube, the at least one weight of the internal assembly continues rearward movement to compress the dead-blow biasing member; and wherein compression of the dead-blow biasing member absorbs rearward inertia of the weight to reduce bounce of the buffer off the closed rear end of the buffer tube.

In some embodiments, the dead-blow biasing member is positioned between and bears against the flat end of the at least one weight of the internal assembly and the rear end cap. In some embodiments, the dead-blow biasing member is positioned between and bears against the flat ends of adjacent weights. In some embodiments, the dead-blow biasing member comprises one of a coil compression spring, a plurality of wave washers, a compression washer, or a compliant portion integrally formed in the rear end cap. In some embodiments, the dead-blow biasing member comprises a coil compression spring or a plurality of wave washers positioned between and bearing against the flat end of the weight and the rear end cap. In some embodiments, the rear end cap includes a stand-off boss extending forwardly within the coil compression spring or wave washers to prevent full compression of the coil compression spring or wave washers. In some embodiments, the dead-blow biasing member comprises a compliant zone integrally formed with the rear end cap and extending into the buffer cavity. In some embodiments, the compliant zone comprises at least one of holes, ridges, or other empty spaces in the material of the rear end cap. In some embodiments, the dead-blow biasing member comprises a plurality of compression washers between the flat ends of adjacent weights.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
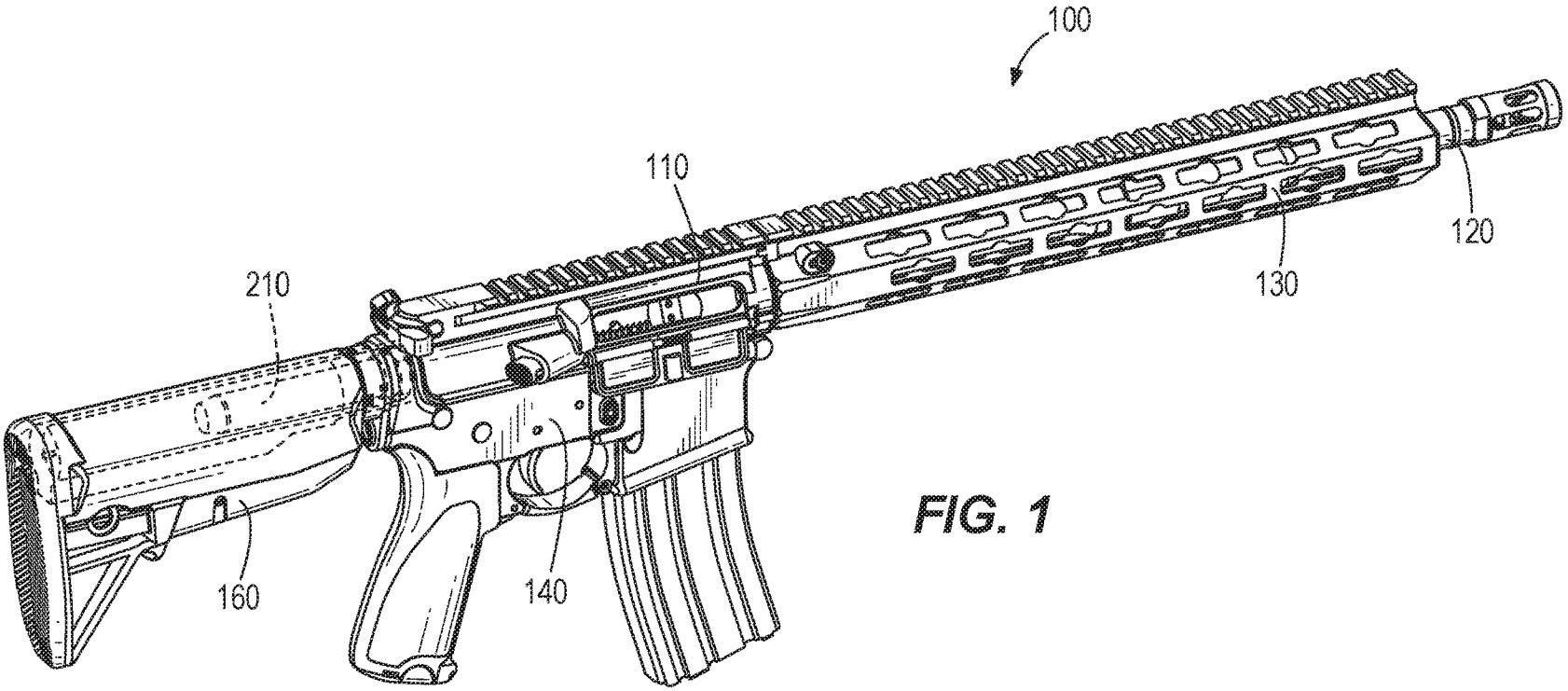
FIG. 1 illustrates an exemplary firearm including an embodiment of the present invention.

FIG. 1 illustrates an exemplary firearm 100 which may embody the present invention. For the purposes of this disclosure, directional and relative terms such as front, forward, rear, and rearward are used from the perspective of a firearm operator using the firearm 100 in its intended way. The illustrated firearm 100 is an AR-15 rifle and includes an upper receiver assembly 110 to which a barrel 120, hand guard 130, lower receiver 140, and buttstock 160 are mounted. The components are generally conventional and well known. A buffer assembly 210 is mounted to the lower receiver 140 and extends into the buttstock 160.

Figure 2:
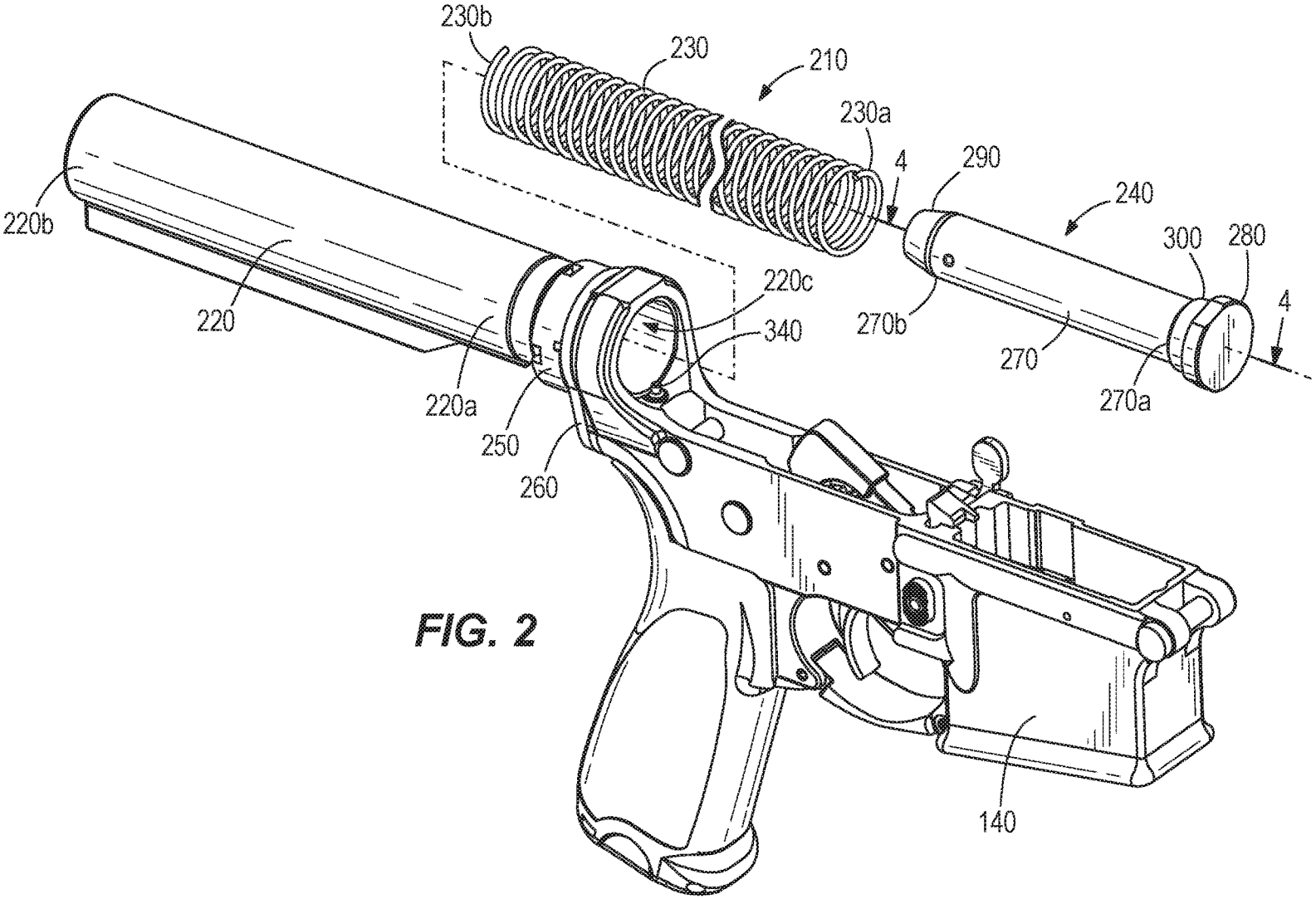
FIG. 2 is an exploded view of a lower receiver assembly of the firearm, including a buffer assembly having a buffer.

FIG. 2 illustrates the buffer assembly 210, which includes a buffer tube 220, a buffer spring 230, and a buffer 240. The buffer tube 220 includes an open front end 220*a*, a closed rear end 220*b*, and a longitudinally-extending internal space 220*c*. The open front end 220*a* of the buffer tube 220 is mounted to the rear of the lower receiver 140 with a castle nut 250 and a receiver end plate 260. The buffer tube 220 extends rearwardly from the lower receiver 140 into the buttstock 160. The buffer spring 230 is a coil compression spring having a front end 230*a* and a rear end 230*b*.

Figure 3:
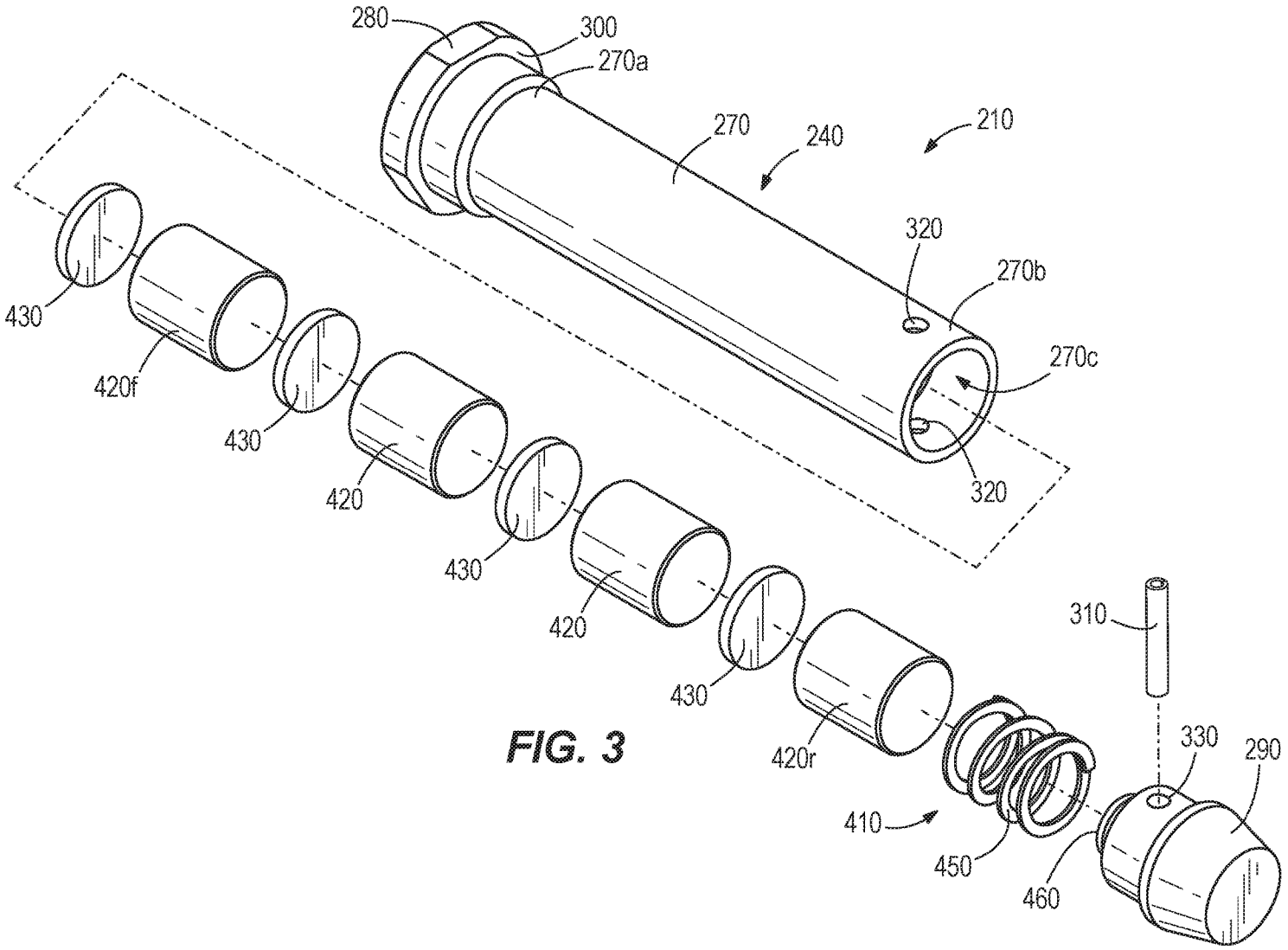
FIG. 3 is an exploded view of the buffer, including a first embodiment of an internal assembly.

With additional reference to FIG. 3, the buffer 240 includes a cylindrical buffer body 270, a front end cap 280, and a rear end cap 290. The buffer body 270 includes a front end 270*a*, a rear end 270*b*, and a longitudinally-extending buffer cavity 270*c*. The front end cap 280 may be threaded onto the front end 270*a* of cylindrical buffer body 270, permanently affixed to the buffer body 270, or integrally formed with the buffer body 270. The front end cap 280 is of wider diameter than the buffer body 270 to define a shoulder 300. The rear end cap 290 is made of a resilient material such as urethane to cushion the impact of the buffer 240 on the rear end 220*b* of the internal space 220*c* of the buffer tube 220 when the buffer 240 is driven rearward as part of the firearm's firing and reloading action. A retaining pin or roll pin 310 is inserted through holes 320 in the rear end 270*b* of the buffer body 270 and through a retaining bore 330 in the rear end cap 290 to secure the rear end cap 290 to the buffer body 270.

Referring again to FIG. 2, the buffer spring 230 and buffer 240 are inserted through the open front end 220*a* of the buffer tube 220 into the internal space 220*c*. The rear end 230*b* of the buffer spring 230 bottoms out in and abuts against the closed rear end 220*b* of internal space 220*c* of the buffer tube 220. The buffer body 270 is surrounded by the coils of the buffer spring 230. The front end 230*a* of the buffer spring 230 abuts the shoulder 300 of the front end cap 280. The buffer spring 230 and buffer 240 are retained in the buffer tube 220 with a buffer retaining pin 340 in the lower receiver 140. The buffer retaining pin 340 is spring biased and can be manually deflected into the lower receiver 140 to provide clearance for insertion of the buffer spring 230 and buffer 240. When released from its deflected condition, the buffer retaining pin 340 extends to trap the buffer spring 230 and buffer 240 in the buffer tube 220.

FIG. 3 illustrates a first embodiment of an internal assembly 410 of the buffer 240. The internal assembly 410 is received in the buffer cavity 270*c* inside the buffer body 270. The internal assembly 410 includes a plurality of conventional weights 420 and conventional resilient spacers 430. The plurality of conventional weights 420 includes a forwardmost weight 420*f* and a rearmost weight 420*r*. Although the illustrated embodiment includes four identically-dimensioned weights 420, it will be understood for the purposes of this embodiment and the embodiments to follow that there may be more or fewer weights having different dimensions depending on the particular application and desired performance of the buffer. The weights 420 may also be made of different materials having different densities to arrive at the desired functionality for the particular application. The weights 420 have planar, flat forward and rearward ends. In this embodiment, a spacer 430 is positioned between the flat ends of adjacent weights 420 and a spacer 430 is positioned between the front end 270*a* of the buffer cavity 270*c* and the forwardmost weight 420*f*.

Figure 4A:
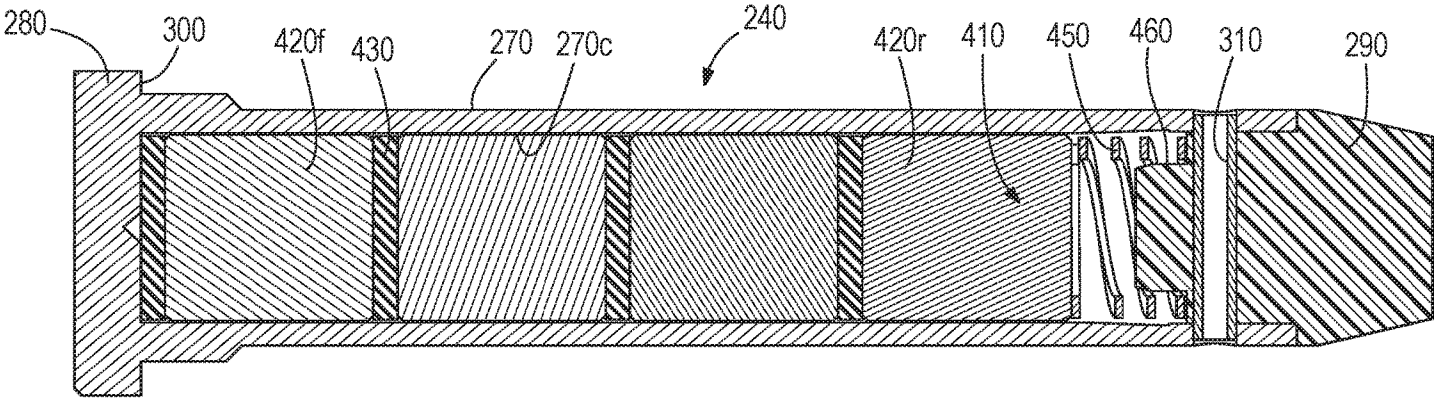
FIG. 4A is cross-sectional view of the buffer of FIG. 3 in an at-rest condition.

The illustrated internal assembly 410 includes a dead-blow biasing member in the form of a flat wire, tempered steel compression spring 450 positioned between and bearing against the flat end of rearmost weight 420*r* and the rear end cap 290. The illustrated internal assembly 410 is designed for use with a rear end cap 290 having a forwardly-extending nipple or stand-off boss 460 around which the rear end of the spring 450 fits. The front end of the spring 450 abuts or bears against the flat end of the rearmost weight 420*r* and the rear end of the spring 450 abuts or bears against the rear end cap 290. FIG. 4A illustrates the internal assembly 410 in an at-rest condition. The spring 450 is slightly compressed between the rearmost weight 420*r* and the rear end cap 290 to keep the weights 420 from sliding freely in the buffer cavity 270*c*.

Figure 4B:
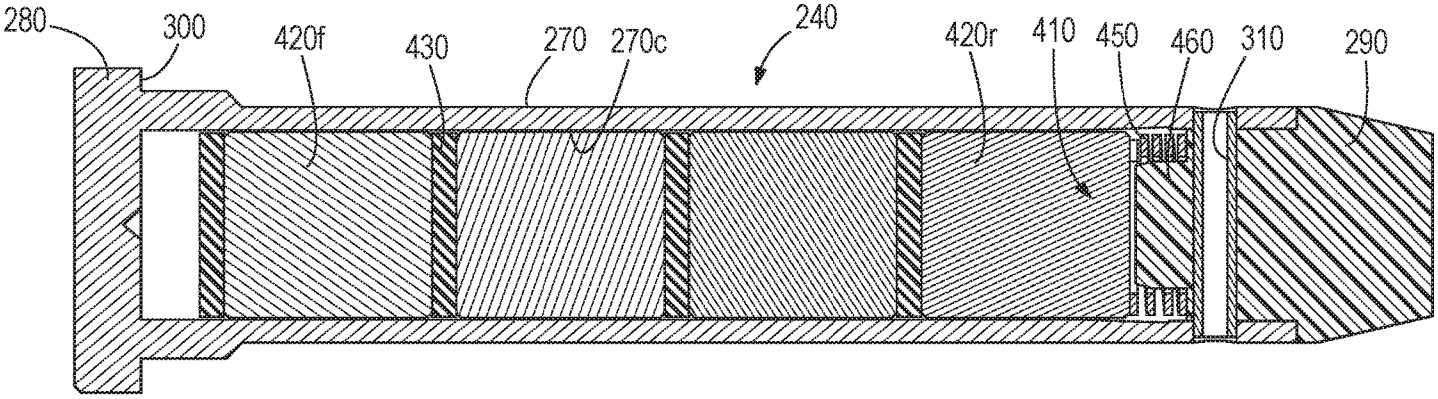
FIG. 4B is cross-sectional view of the buffer of FIG. 3 in a rearward-inertia condition.

FIG. 4B illustrates the internal assembly 410 in a rearward-inertia condition, which is achieved when the buffer 240 is driven rearward by the firearm action and the buffer 240 bottoms out in the internal space 220*c* of the buffer tube 220 (i.e., the rear end cap 290 contacts the rear end 220*b* of the internal space 220*c*). When the buffer 240 bottoms out, the internal weights 420 continue rearward movement due to inertia, which compresses the spring 450 and spacers 430 to absorb rearward inertia of the weights 420. Absorption of rearward inertia of the weights 420 reduces, minimizes, or eliminates bounce or rebound of the buffer 240 at the rear end 220*b* of the buffer tube 220, an effect similar to a dead-blow hammer. For convenience, the dead-blow hammer effect just described (reducing, minimizing, or eliminating bounce or rebound of the buffer 240) is encompassed in the shorthand phrase "reduces bounce of the buffer 240." The rearmost weight 420*r* contacts the stand-off boss 460 to prevent the spring 450 from being fully compressed to preserve the spring's resiliency. The resiliency of the rear end cap 290 and the spacers 430 assists in absorbing the rearward inertia of the weights 420. The buffer spring 230 then drives the buffer 240 forward to initiate the reloading action of the firearm 100.

Figure 5:
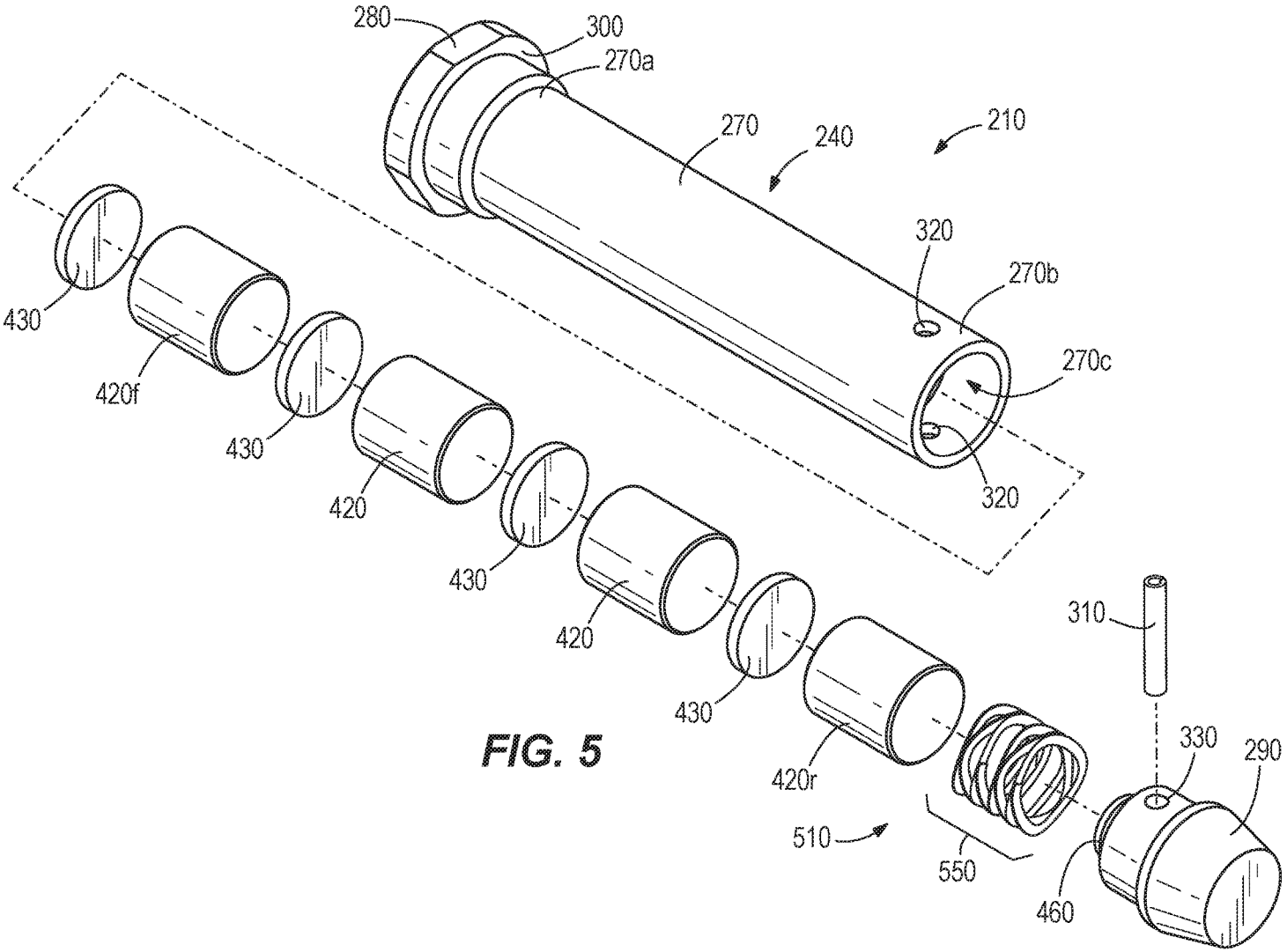
FIG. 5 is an exploded view of the buffer, including a second embodiment of an internal assembly.

FIG. 5 illustrates a second embodiment of an internal assembly 510 of the buffer 240. The internal assembly 510 is identical to the first embodiment 410 but replaces the flat wire spring 450 of the first embodiment 410 with a dead-blow biasing member in the form of a stack of wave washers 550 positioned between and bearing against the flat end of rearmost weight 420*r* and the rear end cap 290. The wave washers 550 fit around the stand-off boss 460 of the rear end cap 290. The front end of the stack of wave washers 550 abuts or bears against the flat end of the rearmost weight 420*r* and the rear end of the stack of wave washers 550 abuts or bears against the rear end cap 290.

Figure 6A:
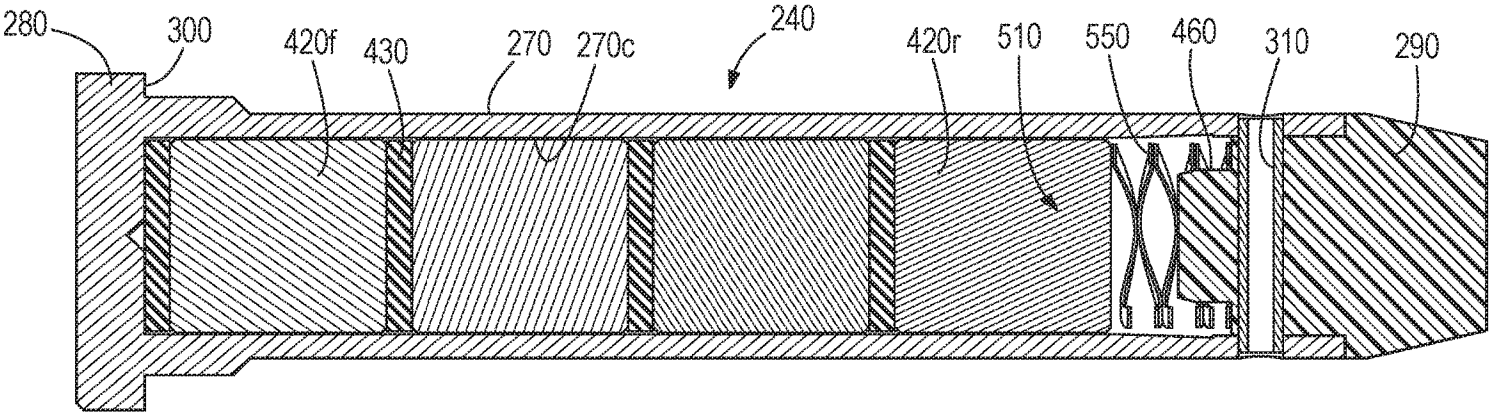
FIG. 6A is cross-sectional view of the buffer of FIG. 5 in an at-rest condition.
Figure 6B:
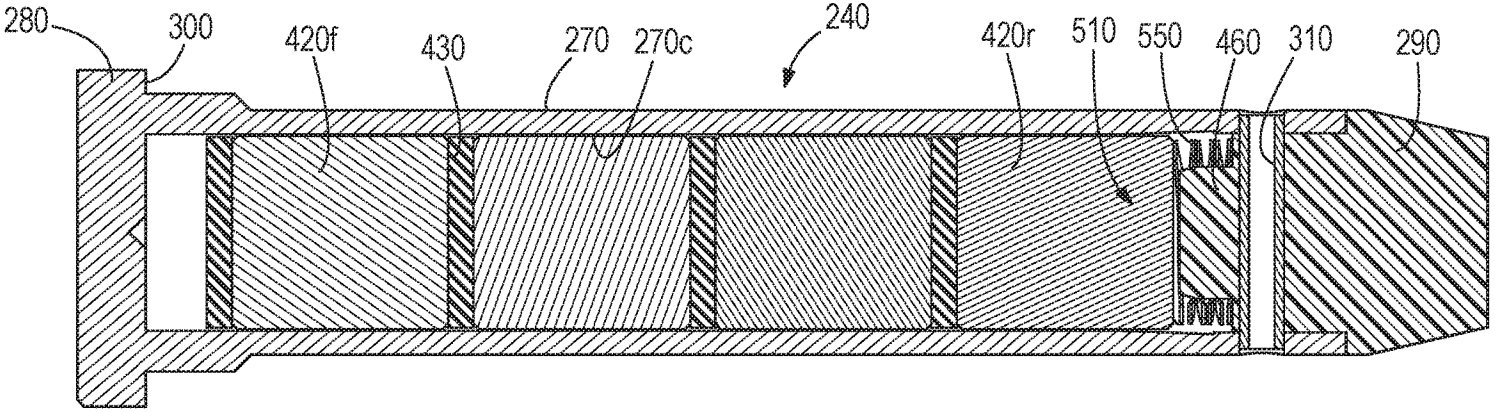
FIG. 6B is cross-sectional view of the buffer of FIG. 5 in a rearward-inertia condition.

FIG. 6A illustrates the internal assembly 510 in an at-rest condition. FIG. 6B illustrates the internal assembly 510 in a rearward-inertia condition, in which the internal weights 420 compress the wave washers 550 to reduce, minimize, or eliminate bounce or rebound of the buffer 240 (i.e., reduces bounce of the buffer 240) at the rear end 220*b* of the buffer tube 220. The stand-off boss 460 extends through the aligned central holes of the stack of wave washers 550. The stand-off boss 460 prevents full compression of the stack of wave washers 550 by contacting the flat end of the weight 420 after a set amount of compression has been achieved.

Figure 7:
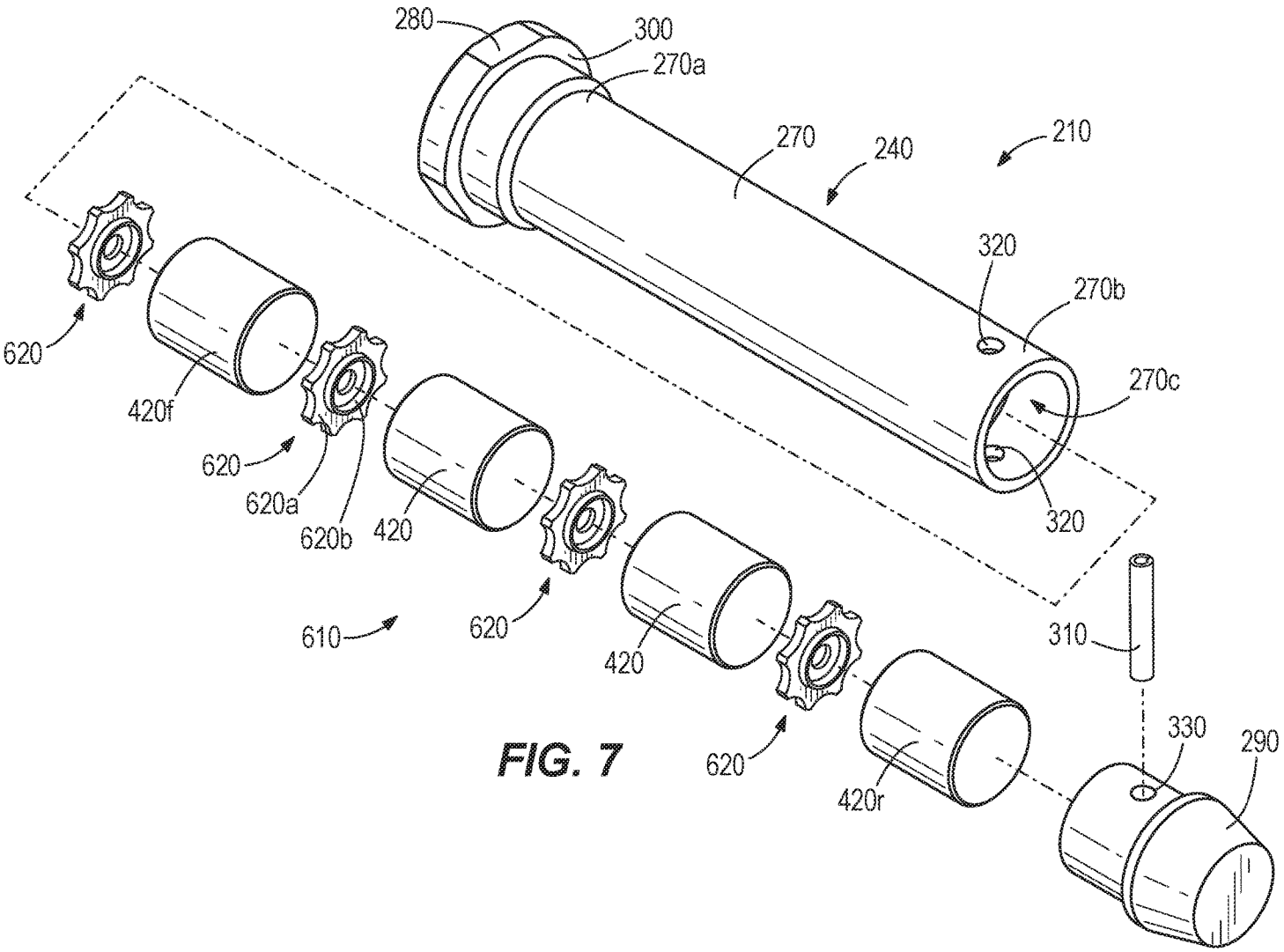
FIG. 7 is an exploded view of the buffer, including a third embodiment of an internal assembly.

FIG. 7 illustrates a third embodiment of an internal assembly 610 of the buffer 240. The internal assembly 610 also includes conventional weights 420, but uses a dead-blow biasing member in the form of compression washers 620 positioned between and bearing against the flat ends of adjacent weights 420. The compression washers 620 include a spacer body 620*a* and a resilient ring 620*b* extending from the spacer body 620*a* in opposite axial directions. A compression washer 620 is positioned between the flat ends of adjacent weights 420 and between the forwardmost weight 420*f* and the forward end of the buffer cavity 270*c*.

Figure 8A:
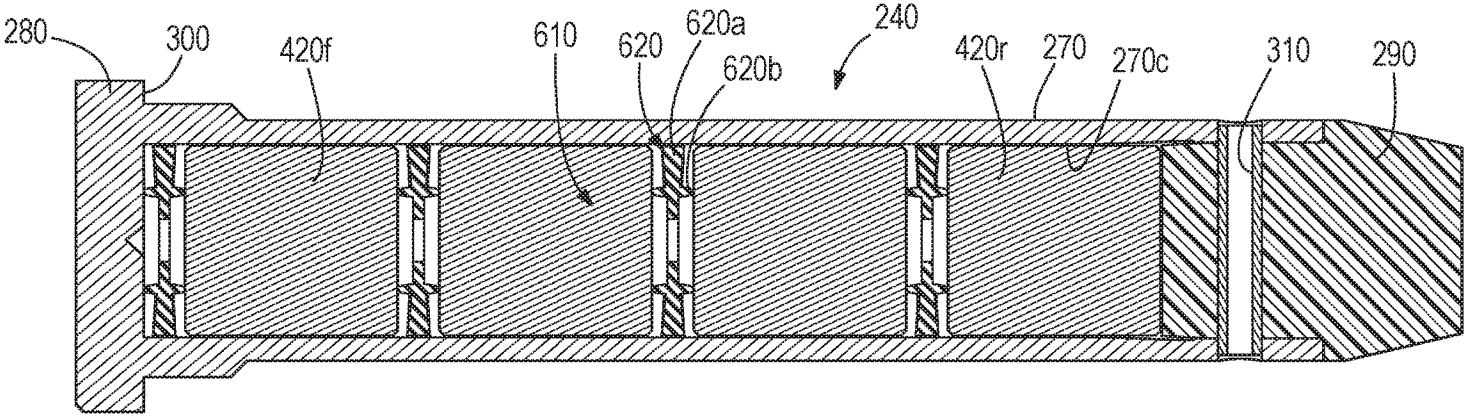
FIG. 8A is cross-sectional view of the buffer of FIG. 7 in an at-rest condition.
Figure 8B:
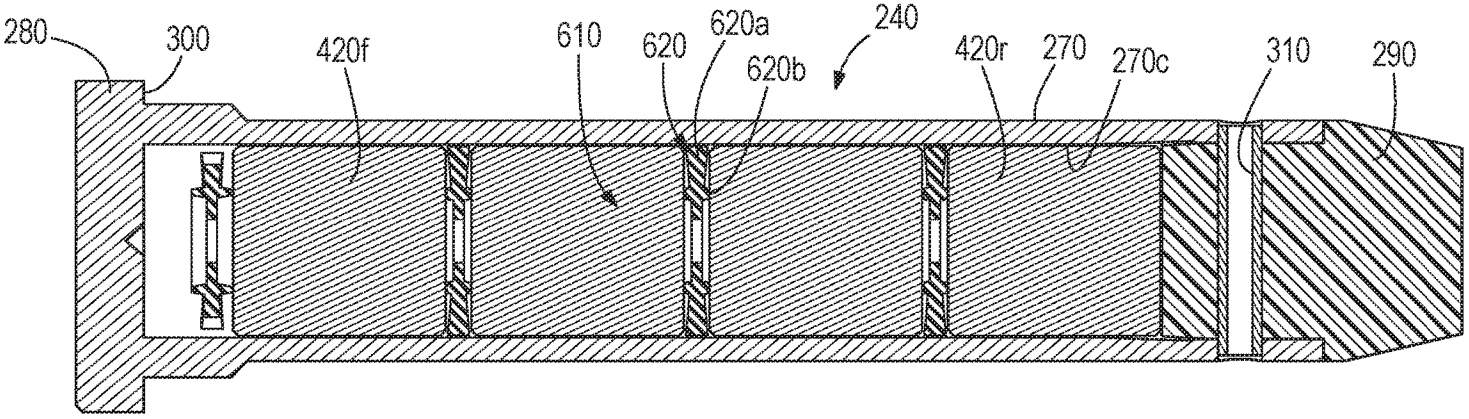
FIG. 8B is cross-sectional view of the buffer of FIG. 7 in a rearward-inertia condition.

FIG. 8A illustrates the internal assembly 610 in an at-rest condition. The resilient rings 620*b* of the compression washers 620 contact the flat ends of the adjacent weights 420 to keep the weights 420 from sliding freely. FIG. 8B illustrates the internal assembly 610 in a rearward-inertia condition, in which the internal weights 420 compress the resilient rings 620*b* to reduce, minimize, or eliminate bounce or rebound of the buffer 240 (i.e., reduces bounce of the buffer 240) at the rear end 220*b* of the buffer tube 220. In alternative assemblies, multiple compression washers 620 could be stacked between adjacent internal weights 420. The third embodiment is not limited to a single compression washer 620 between adjacent weights.

Figure 9A:
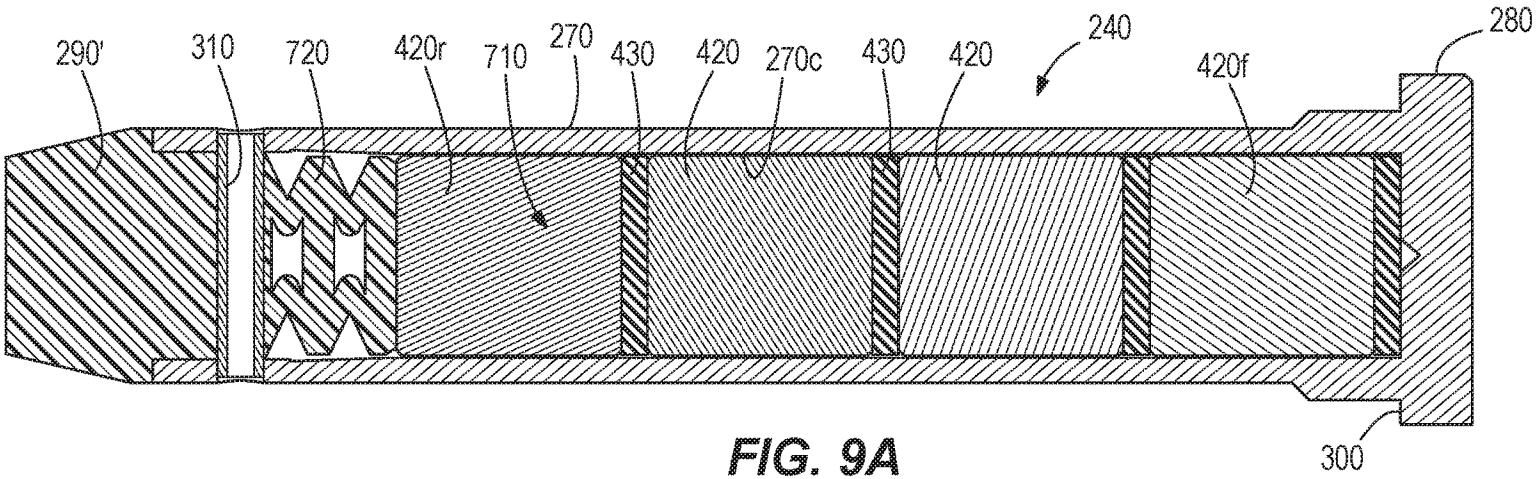
FIG. 9A is a cross-section view of a buffer including an alternative end cap including an integral dead-blow biasing member.
Figure 9B:
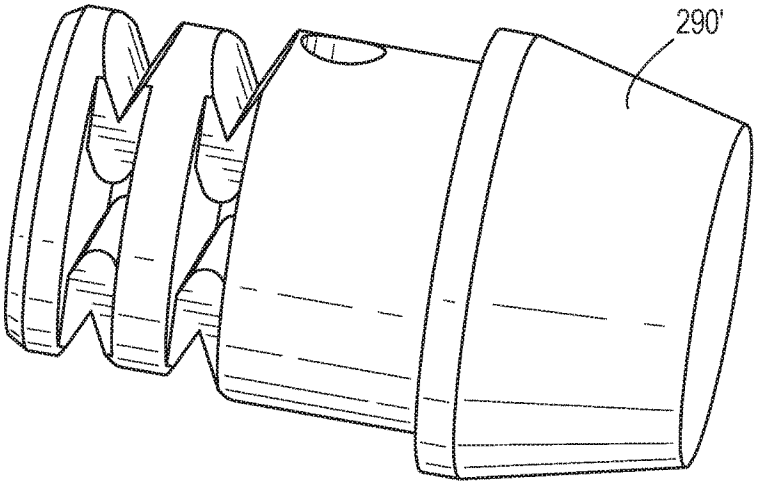
FIG. 9B is a perspective view of the alternative end cap of FIG. 9A.

FIGS. 9A and 9B illustrate an alternative internal assembly 710 of the buffer 240. The internal assembly 710 is received inside the buffer cavity 270*c* inside the buffer body 270. The internal assembly 710 includes conventional weights 420 (including a forwardmost weight 420*f* and a rearmost weight 420*r*) and conventional resilient spacers 430 between the weights 420 as described above. The rear end cap 290' of the internal assembly 710 is a variation on the rear end cap 290 of the prior embodiments in that it incorporates an integral dead-blow biasing member in the form of a compliant zone 720 in the rear end cap 290' positioned between and bearing against the flat end of the rearmost weight 420*r* and the rear end cap 290 (i.e., the rearmost, solid portion of the rear end cap 290'). The front end of the compliant zone 720 abuts or bears against the flat end of the rearmost weight 420*r* and the rear end of the compliant zone 720 can be said to abut or bear against the rear end cap 290'.

The compliant zone 720 is a more compliant, compressible portion of the rear end cap 290' than the rearward portion of the rear end cap 290' which extends outside of the cylindrical buffer body 270. The compliant zone 720 is made integrally with the rear end cap 290' of the same material. The compliant zone 720 extends into the buffer cavity 270*c* and takes the form of any of the following alone or in combination: holes, ridges, or other empty spaces in the material of the forward end of the rear end cap 290'. The compliant zone 720 performs the same function as the dead-blow biasing members 450, 550, 620 described above, which is to deflect under the inertial loading of the weights 420 as the buffer 240 reaches the rear end of its stroke and the weights 420 continue rearward movement due to inertia. Like the earlier embodiments 450, 550, 620, the compliant zone 720 absorbs rearward inertia of the weights 420 to reduce, minimize, or eliminate bounce or rebound of the buffer 240 (i.e., reduces bounce of the buffer 240) at the rear end 220*b* of the buffer tube 220.

Thus, the invention provides, among other things, a buffer assembly that includes a dead-blow biasing member between flat-end weights and/or between the rearmost weight and the rear end cap in the buffer. The dead-blow biasing member reduces, minimizes, or eliminates bounce or rebound of the buffer at the rear end of the buffer tube. Various features and advantages of the invention are set forth in the following claims.

What is claimed is:

1. A buffer assembly for a firearm, the buffer assembly comprising:

a buffer tube including a closed rear end;

a buffer spring in the tube; and a buffer in the tube and engaging the buffer spring, the buffer including a buffer body defining an internal buffer cavity, a rear end cap covering a rear end of the buffer body, and an internal assembly within the buffer cavity, the internal assembly comprising at least one weight having a flat end and a dead-blow biasing member;

wherein the buffer is driven rearwardly in the buffer tube in response to operation of the firearm, to compress the buffer spring;

wherein upon the rear end cap of the buffer contacting the closed rear end of the buffer tube, the at least one weight of the internal assembly continues rearward movement to compress the dead-blow biasing member;

wherein compression of the dead-blow biasing member absorbs rearward inertia of the weight to reduce bounce of the buffer off the closed rear end of the buffer tube;

wherein the dead-blow biasing member comprises a coil compression spring or a plurality of wave washers; and wherein the rear end cap includes a stand-off boss extending forwardly within the coil compression spring or wave washers to prevent full compression of the coil compression spring or wave washers.

2. The buffer assembly of claim 1, wherein the dead-blow biasing member is positioned between and bears against the flat end of the at least one weight of the internal assembly and the rear end cap.

3. A buffer assembly for a firearm, the buffer assembly comprising:

a buffer tube including a closed rear end;

a buffer spring in the tube; and a buffer in the tube and engaging the buffer spring, the buffer including a buffer body defining an internal buffer cavity, a rear end cap covering a rear end of the buffer body, and an internal assembly within the buffer cavity, the internal assembly comprising at least one weight having a flat end and a dead-blow biasing member;

wherein the buffer is driven rearwardly in the buffer tube in response to operation of the firearm, to compress the buffer spring;

wherein upon the rear end cap of the buffer contacting the closed rear end of the buffer tube, the at least one weight of the internal assembly continues rearward movement to compress the dead-blow biasing member;

wherein compression of the dead-blow biasing member absorbs rearward inertia of the weight to reduce bounce of the buffer off the closed rear end of the buffer tube; and wherein the dead-blow biasing member comprises a compliant zone integrally formed with the rear end cap and extending into the buffer cavity.

4. The buffer assembly of claim 3, wherein the compliant zone comprises at least one of holes, ridges, or other empty spaces in the material of the rear end cap.

5. The buffer assembly of claim 3, wherein the dead-blow biasing member bears against the flat end of the at least one weight of the internal assembly.

* * * * *